US006830356B2

(12) United States Patent
Larocque

(10) Patent No.: US 6,830,356 B2
(45) Date of Patent: Dec. 14, 2004

(54) MAGNIFYING AND ILLUMINATING LECTERN OR LECTERN ADAPTOR

(76) Inventor: André Larocque, 63, Laflueur, Lasalle, Quebec (CA), H8R 3G7

( * ) Notice: Subject to any disclaimer, the term of this patent is extended or adjusted under 35 U.S.C. 154(b) by 0 days.

(21) Appl. No.: 10/355,506

(22) Filed: Jan. 31, 2003

(65) Prior Publication Data

US 2004/0150985 A1 Aug. 5, 2004

(51) Int. Cl.[7] ..... A47B 19/00

(52) U.S. Cl. ..... 362/98; 362/127; 108/23; 248/444.1

(58) Field of Search ..... 362/98, 99, 127; 108/23; 248/444.1; 359/798–801

(56) References Cited

U.S. PATENT DOCUMENTS 4,036,465 A 7/1977 Kellner
4,089,046 A 5/1978 Cannon
4,127,253 A 11/1978 Ben-Lea
4,496,127 A 1/1985 Nelson
4,552,382 A 11/1985 Cowden
4,998,185 A * 3/1991 DeNigris, Jr. ..... 362/98
5,610,770 A 3/1997 Galiani
5,639,156 A * 6/1997 Broxson ..... 362/99
6,116,562 A 9/2000 Griffin
6,443,588 B1 * 9/2002 Nunez ..... 362/99

* cited by examiner

*Primary Examiner*—Stephen F Husar

(57) ABSTRACT

A magnifying and illuminating apparatus which can both be fitted onto existing lecterns or used as an integral part of an improved lectern and which combines a light source and a magnifying element in order to improve visibility of the viewable material placed under it.

2 Claims, 2 Drawing Sheets

Figure 1:
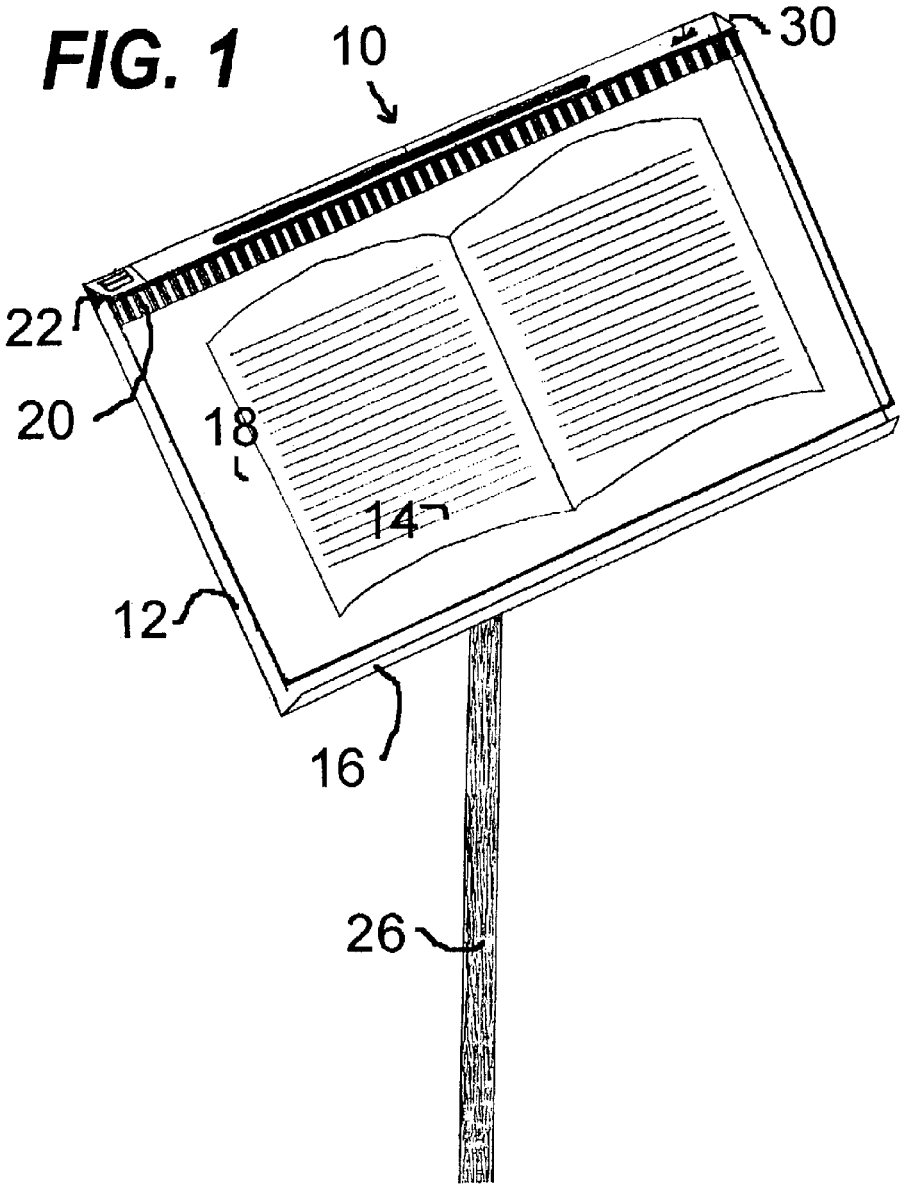

10
30
22
20
18
14
12
16
26

MAGNIFYING AND ILLUMINATING LECTERN OR LECTERN ADAPTOR

This application claims priority based on Canadian patent application 2,369,468 Feb. 1, 2002

BACKGROUND OF THE INVENTION

1. Field of the Invention

This invention relates generally to stands or lecterns for books or music partitions but more particularly to an apparatus having a magnifying element to ease the reading of the material laid on a lectern.

2. Background

Music sheet lecterns used by musicians in orchestras, chamber music, or even in solo have not evolved much in the past few centuries. Whereas in the past people were used to reading in low light conditions that could strain their eyes to the point of inpairing their eyesights, today's musicians are not ready for such sacrifice and efforts and often require the help of a small lighting fixture to illuminate their music partition. Even so, the contrast of an illuminated source with the otherwise darker auditorium or concert hall can cause eyestrain, headaches and other such discomfort when one has to read rather small markings on the music partition.

A variety of devices exist to support reading material. The prior art shows lecterns or stands having protective transparent covers to protect a viewable material set underneath, other inventions have lighting to illuminate the viewable material and there are even a few examples where a magnifying panel is used to magnify the viewable material.

The prior art of record, however, does not show inventions that could be combined to provide all of the advantages of this present invention without requiring unobvious changes or modifications. There is therefore a need for a practical lectern that combines proper illumination and a magnifying capability which also doubles as a protective cover for the viewable material while allowing for the viewable material to be easily removed or changed such as when flipping pages.

SUMMARY OF THE INVENTION

A first object of the present invention is to provide a practical and easy to mount and dismount adaptor for lecterns.

A second object is to provide a useful lectern adaptor which provides adequate illumination to the viewable material.

A third object is to provide a lectern adaptor which provides magnification of the viewable material for ease of viewing and/or reading.

A fourth object is to provide a hinged connected magnifying element which can be lifted to allow access for a user to the viewable material.

A final object is to provide an improved lectern having all of the above features in lieu of just an adaptor for existing lecterns.

In order to do so, the invention combines a magnifying and an illuminating component which can both be fitted onto existing lecterns or such stands as those already built-in onto pianos and other large keyboard type instruments. It can also be provided as an integral part of an improved lectern, combining a light source and a magnifying element such as a fresnel lens, micro lenticular systems or any other type of thin and lightweight magnifying element. Moreover, the magnifying element is hingeably connected to the rest of the lectern to make it easily liftable when the user wishes to move, take in/out or otherwise adjust the viewable material.

The foregoing and other objects, features, and advantages of this invention will become more readily apparent from the following detailed description of a preferred embodiment with reference to the accompanying drawings, wherein the preferred embodiment of the invention is shown and described, by way of examples. As will be realized, the invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE PREFERRED EMBODIMENT

FIG. 1 Isometric view of the lectern shown generally.

Figure 2:
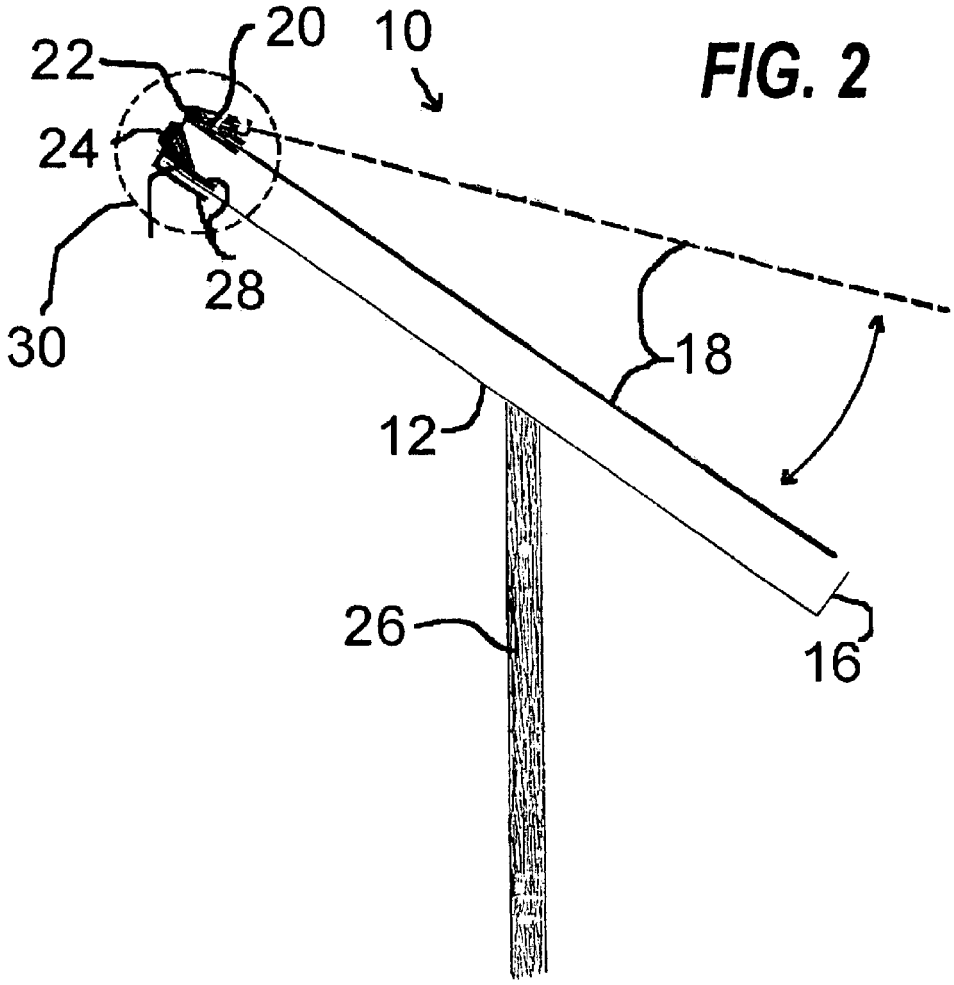

FIG. 2 Side elevation of the lectern.

DETAILED DESCRIPTION OF THE PREFERRED EMBODIMENT

A magnifying and illuminating lectern adaptor (10) is generally adapted onto an existing lectern surface (12) upon which rests viewable material (14) this lectern surface (12) is pretty much like any typical lectern in the fact that it has a lip (16) at its base to hold the viewable material (14) which could otherwise fall off.

A magnifying element (18) made of a transparent generally planar material, at rest, stands over and parallel to the lectern surface (12) and magnifies the appearance of the viewable material (14). To further enhance viewability, an artificial light source (20), positioned and configured to project as much of a homogeneous level of light as possible over the entire area of the viewing material (14) allows for viewing even when located in a dimly lit environment. It is preferable that as little light as possible strays or leaks out of the viewing material area (14) so as not to distract other people around, such as other users of similar magnifying and illuminating lectern adaptor (10) as in, for example, an orchestra. Such methods are well known and involve the properties of light when reflecting over various surfaces such as mirrors, flat, convex or concave, as well as transmission and reflection on flat surfaces of transparent glasses or plastic which have varying degrees of reflectivity and transmission depending upon the incident angle of the rays of light.

Placement of the viewale material (14) is made easy by the use of at least one hinge (22) to hingeably connect the magnifying element (18) to a head module (30) and which allows the magnifying element (18) to be lifted. The head module (30) is contained within the area inside the dotted circle of FIG. 2 and is further comprised of the artificial light source (20), an optional interrupter (24) to switch the artificial light source (20) on or off and a pincer (28) which frictionally engages the lectern surface (12). Any type of power source can be used for powering the artificial light source (20) which can make the magnifying and illuminating lectern adaptor (10) totally independent or otherwise tethered to a power cord. The magnifying and illuminating lectern adaptor (10) can rest on a surface such as on a piano, some of which already having a built-in support for music sheets and upon which the magnifying and illuminating lectern adaptor (10) can simply rest over the music partition.

The magnifying element (12) can be removed from the hinge (22) to be replaced by another having a different degree of magnification. It should be understood that features such as anti-reflection and anti-scratch coatings on the surface of the magnifying element are desirable features that could easily be included.

What is claimed is:

1. A magnifying and illuminating lectern adaptor to facilitate the reading of viewable material having a magnifying element made of a transparent generally planar material positioned over and relatively parallel to the surface of a lectern;

an artificial light source to illuminate viewing material;

and comprising:

a head module to contain the artificial light source, at least one hinge, and at least one pincer;

said at least one hinge hingeably connecting said magnifying element to enable a user to lift said magnifying element and access viewable material placed underneath said magnifying element;

said at least one pincer to frictionally engage a lectern surface;

said artificial light source being substantially as wide as the width of said magnifying element.

2. A magnifying and illuminating lectern as in claim 1 wherein said lectern being comprising a stand.

* * * * *